US009724918B2

(12) United States Patent
Horiuchi

(10) Patent No.: US 9,724,918 B2
(45) Date of Patent: Aug. 8, 2017

(54) LIQUID EJECTING HEAD AND RECORDING DEVICE INCLUDING THE SAME

(71) Applicant: KYOCERA Corporation, Kyoto-shi, Kyoto (JP)

(72) Inventor: Kosei Horiuchi, Aira (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 15/194,901

(22) Filed: Jun. 28, 2016

(65) Prior Publication Data

US 2016/0303853 A1 Oct. 20, 2016

Related U.S. Application Data

(63) Continuation of application No. PCT/JP2015/074054, filed on Aug. 26, 2015.

(30) Foreign Application Priority Data

Mar. 6, 2015 (JP) ..... 2015-044845

(51) Int. Cl.
*B41J 2/14* (2006.01)

(52) U.S. Cl.
CPC ..... *B41J 2/1433* (2013.01); *B41J 2/14209* (2013.01); *B41J 2002/14225* (2013.01); *B41J 2002/14306* (2013.01); *B41J 2002/14459* (2013.01)

(58) Field of Classification Search
CPC .. B41J 2/1433; B41J 2/14; B41J 2002/14411; B41J 2/135; B41J 2002/14346; B41J 2002/14306; B41J 2/17513; B41J 2/17523; B41J 2002/14225; B41J 2002/14459; B41J 2/14209; B41J 2/14233; B41J 2/161
USPC ..... 347/20, 47, 54, 87
See application file for complete search history.

(56) References Cited

FOREIGN PATENT DOCUMENTS

JP 2006-187967 A 7/2006
JP 2013-208813 A 10/2013

OTHER PUBLICATIONS

Office Action mailed on Jun. 21, 2016 and issued by Japanese Patent Office for a corresponding Japanese Patent Application No. 2016-077367.
International Search Report (Form PCT/ISA/210) mailed on Nov. 17, 2015 and issued for PCT Application No. PCT/JP2015/074054.

*Primary Examiner* — Jannelle M Lebron
(74) *Attorney, Agent, or Firm* — Volpe and Koenig, P.C.

(57) ABSTRACT

A liquid ejecting head includes a first compression chamber row 11A on other side of a sub-manifold 5*a*, which extends in one direction, in other direction, and a second compression chamber row 11B on one side of the sub-manifold 5*a* in the other direction. First restricting-portion bodies 6Aa and second restricting-portion bodies 6Ba extend in a direction that crosses the one direction, and are alternately arranged in the one direction. First inlets 6Ab are on the one side of the second outlets 6Bc in the other direction. The first inlets 6Ab have an opening width greater than an opening width of the second outlets 6Bc. Channels of the second restricting portions 6B have a similar configuration.

19 Claims, 8 Drawing Sheets

LIQUID EJECTING HEAD AND RECORDING DEVICE INCLUDING THE SAME

RELATED APPLICATIONS

The present application is a continuation application of PCT Application No. PCT/JP2015/074054 filed on Aug. 26, 2015, which claims priority to and the benefit of Japanese Patent Application No. 2015-044845 filed on Mar. 6, 2015, the contents of both are hereby expressly incorporated by reference.

TECHNICAL FIELD

The present invention relates to a liquid ejecting head and a recording device including the liquid ejecting head.

BACKGROUND ART

A known example of a liquid ejecting head is an inkjet head that performs various types of printing by ejecting liquid toward a recording medium. A liquid ejecting head includes a channel member provided with ejection holes, compression chambers, and common channels. A known channel member includes a plurality of metal plates that are stacked together, the metal plates having holes or grooves that constitute channels. The metal plates are bonded together with an adhesive. The metal plates have adhesive receiving grooves arranged so as to surround the holes or grooves to reduce the amount of adhesive that flows into the holes or grooves in the bonding process. The annular receiving grooves are connected to each other (see, for example, PTL 1).

Depending on the arrangement of the channels, even when receiving grooves similar to those described in PTL 1 are to be arranged around the channels, adhesion areas may be reduced as a result of the receiving grooves being close to receiving grooves for nearby channels, or there may not be enough space to arrange the receiving grooves. In particular, restricting portions, which are channels that connect the compression chambers to the common channels, are densely arranged. Therefore, the receiving grooves cannot be arranged so as to surround the restricting portions, and the shape of the channels may be changed due to the adhesive that flows into the channels. In such a case, variations in the channel characteristics of the restricting portions are increased, and variations in the ejection characteristics are increased accordingly.

CITATION LIST

Patent Literature

PTL 1: Japanese Unexamined Patent Application Publication No. 2006-187967

SUMMARY OF INVENTION

Technical Problem

Accordingly, a liquid ejecting head capable of reducing the possibility that an adhesive will flow into restricting portions and a recording device including the liquid ejecting head are provided.

SOLUTION TO PROBLEM

A liquid ejecting head according to one aspect includes a channel member including a plurality of ejection holes, a plurality of compression chambers connected to the plurality of ejection holes, and a common channel that supplies liquid to the plurality of compression chambers; and a plurality of compressing portions that compress the liquid in the plurality of compression chambers. The channel member includes a plurality of plates that include a hole or a groove and that are stacked together, the hole or the groove constituting a channel. In plan view of the channel member, the common channel is long in one direction, and two compression chamber rows, in which the plurality of compression chambers are arranged next to each other, are arranged one on each side of the common channel so as to extend in the one direction, one of the two compression chamber rows being defined as a first compression chamber row and another of the two compression chamber rows being defined as a second compression chamber row. In addition, the compression chambers belonging to the first compression chamber row are connected to the common channel by first restricting portions, the first restricting portions including first restricting-portion bodies that extend in a direction perpendicular to a stacking direction, first inlets that connect the first restricting-portion bodies to the common channel in the stacking direction at a side of the first restricting-portion bodies that is adjacent to the common channel, and first outlets that connect the first restricting-portion bodies to the compression chambers in the stacking direction at a side of the first restricting-portion bodies that is adjacent to the compression chambers. The compression chambers belonging to the second compression chamber row are connected to the common channel by second restricting portions, the second restricting portions including second restricting-portion bodies that extend in a direction perpendicular to the stacking direction, second inlets that connect the second restricting-portion bodies to the common channel in the stacking direction at a side of the second restricting-portion bodies that is adjacent to the common channel, and second outlets that connect the second restricting-portion bodies to the compression chambers in the stacking direction at a side of the second restricting-portion bodies that is adjacent to the compression chambers. The first restricting-portion bodies and the second restricting-portion bodies extend in a direction that crosses the one direction and are alternately arranged in the one direction. When a direction perpendicular to the one direction is defined as other direction, the first inlets are on one side of the second outlets in the other direction, the second inlets are on other side of the first outlets in the other direction, and the first inlets have an opening width greater than an opening width of the second outlets, and the second inlets have an opening width greater than an opening width of the first outlets.

A recording device according to another aspect includes the liquid ejecting head, a conveying unit that conveys a recording medium relative to the liquid ejecting head, and a control unit that controls the liquid ejecting head.

DESCRIPTION OF EMBODIMENTS

Figure 1A:
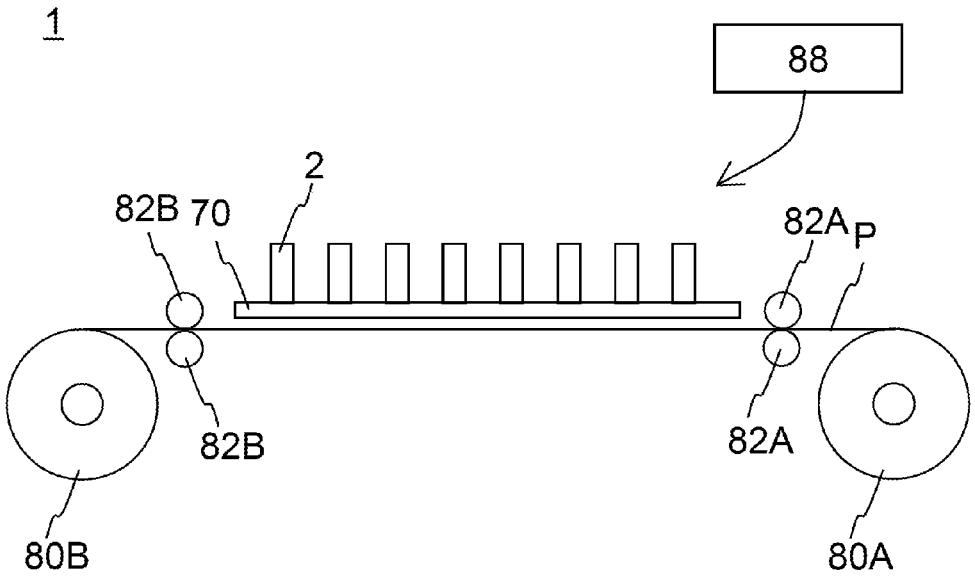
FIGS. 1(*a*) and 1(*b*) are a side view and a plan view, respectively, of a recording device including liquid ejecting heads according to an embodiment of the present invention.
Figure 1B:
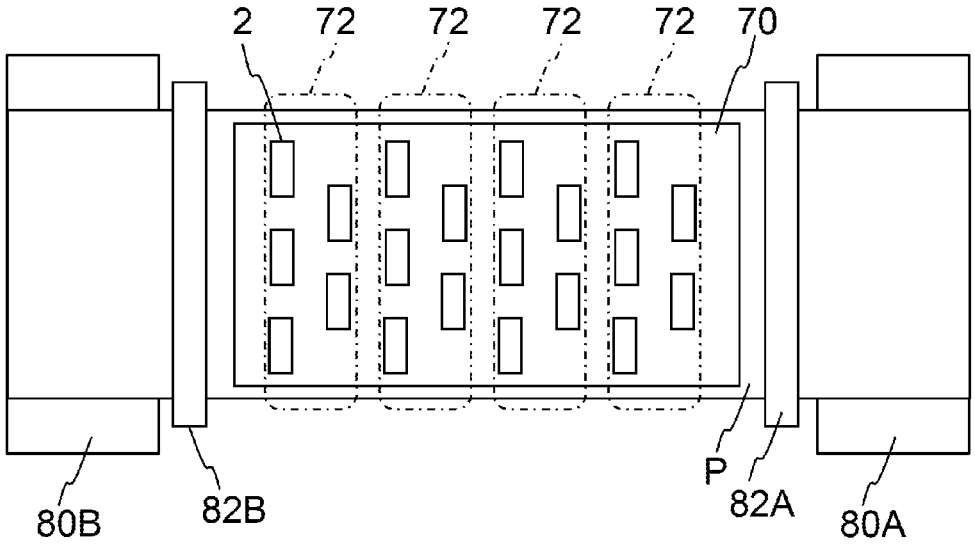

FIGS. 1(*a*) and 1(*b*) are a schematic side view and a schematic plan view, respectively, of a color inkjet printer 1 (hereinafter sometimes referred to simply as a printer), which is a recording device including liquid ejecting heads 2 according to an embodiment of the present invention. The printer 1 moves a print sheet P, which is a recording medium, relative to the liquid ejecting heads 2 by conveying the print sheet P from guide rollers 82A to conveying rollers 82B. A control unit 88 controls the liquid ejecting heads 2 on the basis of image or character data so that the liquid ejecting heads 2 eject liquid toward the recording medium P. Recording, such as printing, is performed on the print sheet P by applying liquid droplets to the print sheet P.

In the present embodiment, the liquid ejecting heads 2 are fixed to the printer 1. The printer 1 is a line printer. A recording device according to another embodiment may be a serial printer in which an operation of moving the liquid ejecting heads 2 in a direction that crosses a conveying direction of the print sheet P, for example, in a direction substantially perpendicular to the conveying direction of the print sheet P, and an operation of conveying the print sheet P are alternately performed.

A flat plate-shaped head mounting frame 70 (hereinafter sometimes referred to simply as a frame) is fixed to the printer 1 such that the frame 70 is substantially parallel to the print sheet P. The frame 70 has twenty holes (not shown). Twenty liquid ejecting heads 2 are placed in the holes in such a manner that portions of the liquid ejecting heads 2 from which the liquid is ejected face the print sheet P. The distance from the liquid ejecting heads 2 to the print sheet P is, for example, about 0.5 mm to 20 mm. Every five liquid ejecting heads 2 form a single head group 72; accordingly, the printer 1 includes four head groups 72.

The liquid ejecting heads 2 have a long and narrow shape that extends in a direction from the near side toward the far side in FIG. 1(*a*), which is a vertical direction in FIG. 1(*b*). The direction in which the liquid ejecting heads 2 extend may be referred to as a long-side direction. In each head group 72, three liquid ejecting heads 2 are arranged in a direction that crosses the conveying direction of the print sheet P, for example, in a direction substantially perpendicular to the conveying direction of the print sheet P. The remaining two liquid ejecting heads 2 are arranged at locations shifted from the three liquid ejecting heads 2 in the conveying direction, and each of the two liquid ejecting heads 2 is disposed between the three liquid ejecting heads 2. The liquid ejecting heads 2 are arranged such that printable areas thereof are connected to each other, or overlap at the ends, in the width direction of the print sheet P (direction that crosses the conveying direction of the print sheet P). Thus, an image that is continuous in the width direction of the print sheet P can be printed.

The four head groups 72 are arranged in the conveying direction of the recording sheet P. Each liquid ejecting head 2 receives liquid, for example, ink, from a liquid tank (not shown). The liquid ejecting heads 2 belonging to each head group 72 receive ink of the same color, so that the four head groups 72 are capable of performing printing by using inks of four colors. The colors of inks ejected from the head groups 72 are, for example, magenta (M), yellow (Y), cyan (C), and black (K). Color image printing can be performed by using these inks under the control of the control unit 88.

If monochrome printing is to be performed over an area within a printable area of a single liquid ejecting head 2, the number of liquid ejecting heads 2 to be mounted on the printer 1 may be one. The number of liquid ejecting heads 2 belonging to each head group 72 and the number of head groups 72 may be changed as appropriate depending on the printing subject and printing conditions. For example, the number of head groups 72 may be increased to increase the number of colors that can be printed. When a plurality of head groups 72 that perform printing in the same color are provided and caused to perform printing alternately in the conveying direction, the conveying speed can be increased without changing the performance of the liquid ejecting heads 2. In this case, the print area per unit time can be increased. Alternatively, a plurality of head groups 72 that perform printing in the same color may be arranged at locations shifted from each other in a direction that crosses the conveying direction to increase the resolution in the width direction of the print sheet P.

Instead of performing printing by using colored ink, surface treatment for the print sheet P may be performed by applying liquid such as a coating agent to the print sheet P.

The printer 1 prints on the print sheet P. The print sheet P is wound around a feed roller 80A. The print sheet P passes through the space between the two guide rollers 82A, the space below the liquid ejecting heads 2 mounted on the frame 70, and the space between the two conveying rollers 82B, and is finally wound around a take-up roller 80B. In a printing operation, the conveying rollers 82B are rotated so that the print sheet P is conveyed at a constant speed, and the liquid ejecting heads 2 performs printing. The print sheet P conveyed by the conveying rollers 82B is wound around the take-up roller 80B. The conveying speed is, for example, 75 m/min. Each roller may be controlled either by the control unit 88 or manually by a user.

The recording medium may be a roll of cloth instead of the print sheet P. The printer 1 may convey the recording medium by placing the recording medium on a conveying belt and directly moving the conveying belt instead of directly conveying the print sheet P. In this case, a cut sheet, a cut piece of cloth, a wood piece, a tile, etc., may be used as the recording medium. The liquid ejecting heads 2 may eject liquid containing conductive powder to print, for example, a wiring pattern of an electronic device. Alternatively, the liquid ejecting heads 2 may eject a predetermined amount of liquid chemical agent or liquid containing a chemical agent toward a reaction chamber to create a reaction for producing a chemical.

Position sensors, speed sensors, temperature sensors, etc., may be attached to the printer 1. The control unit 88 may control each part of the printer 1 in accordance with the states of the parts of the printer 1 that can be determined from information obtained by the sensors. For example, when the temperature of the liquid ejecting heads 2, the temperature of the liquid in the liquid tank, and the pressure applied to the liquid ejecting heads 2 by the liquid in the liquid tank affect the ejection characteristics, such as the ejection amount and ejection speed of the liquid, driving signals used to eject the liquid may be changed in accordance with these pieces of information.

Figure 2:
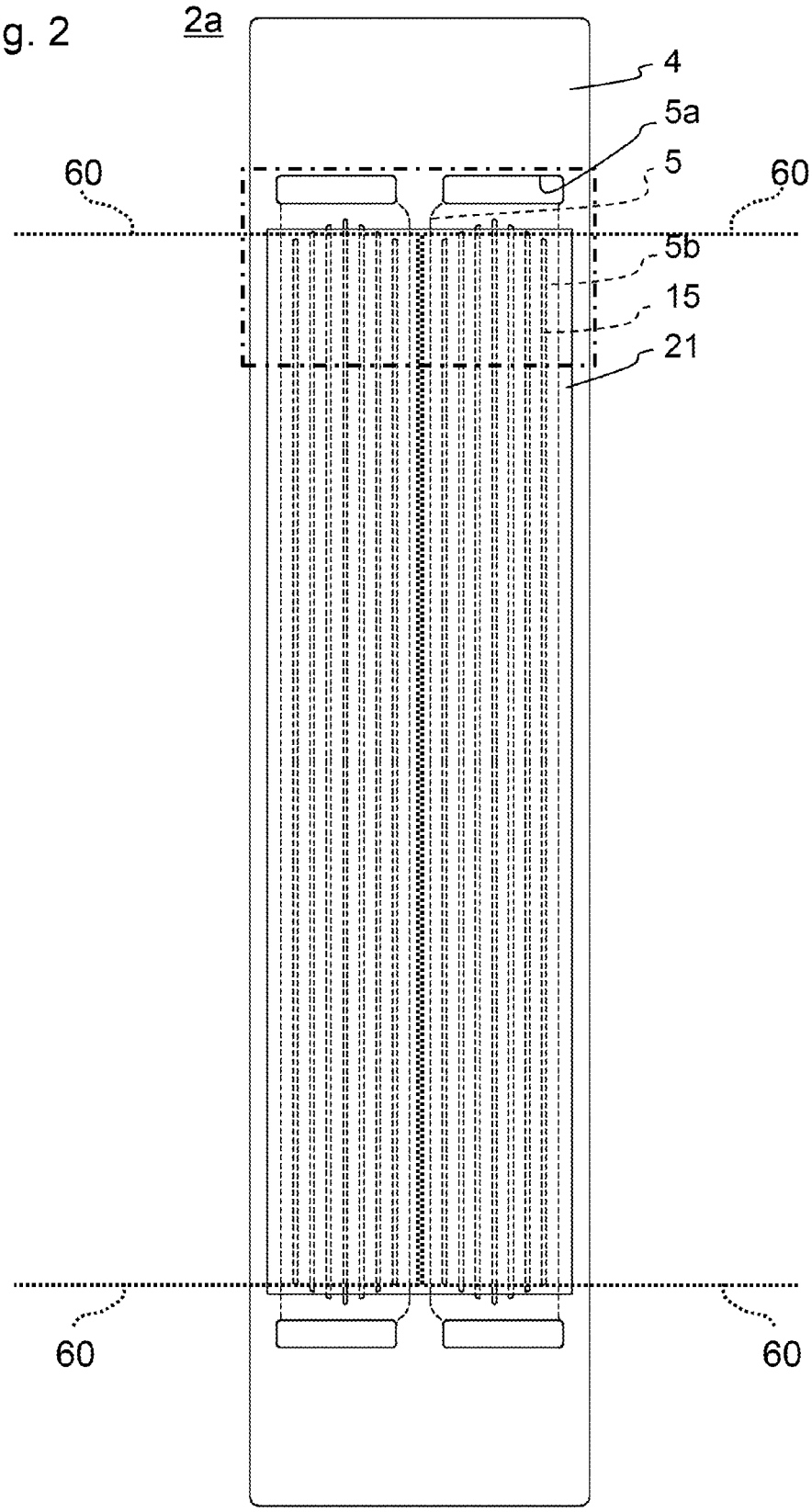
FIG. 2 is a plan view of a head body, which is a main portion of each liquid ejecting head in FIG. 1.
Figure 3:
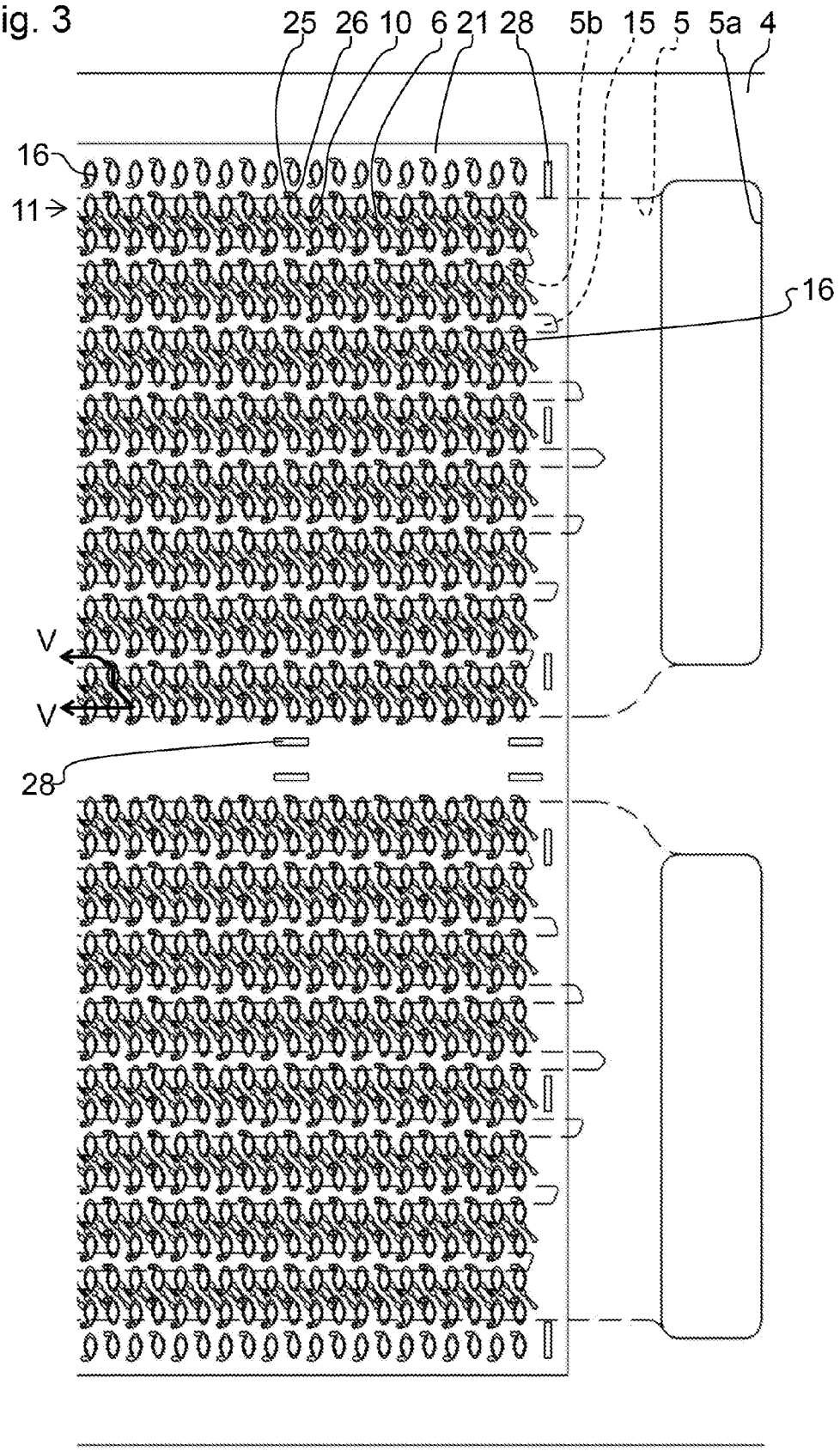
FIG. 3 is an enlarged view of the region enclosed by the dotted-chain line in FIG. 2, where some channels are omitted to simplify the description.
Figure 4:
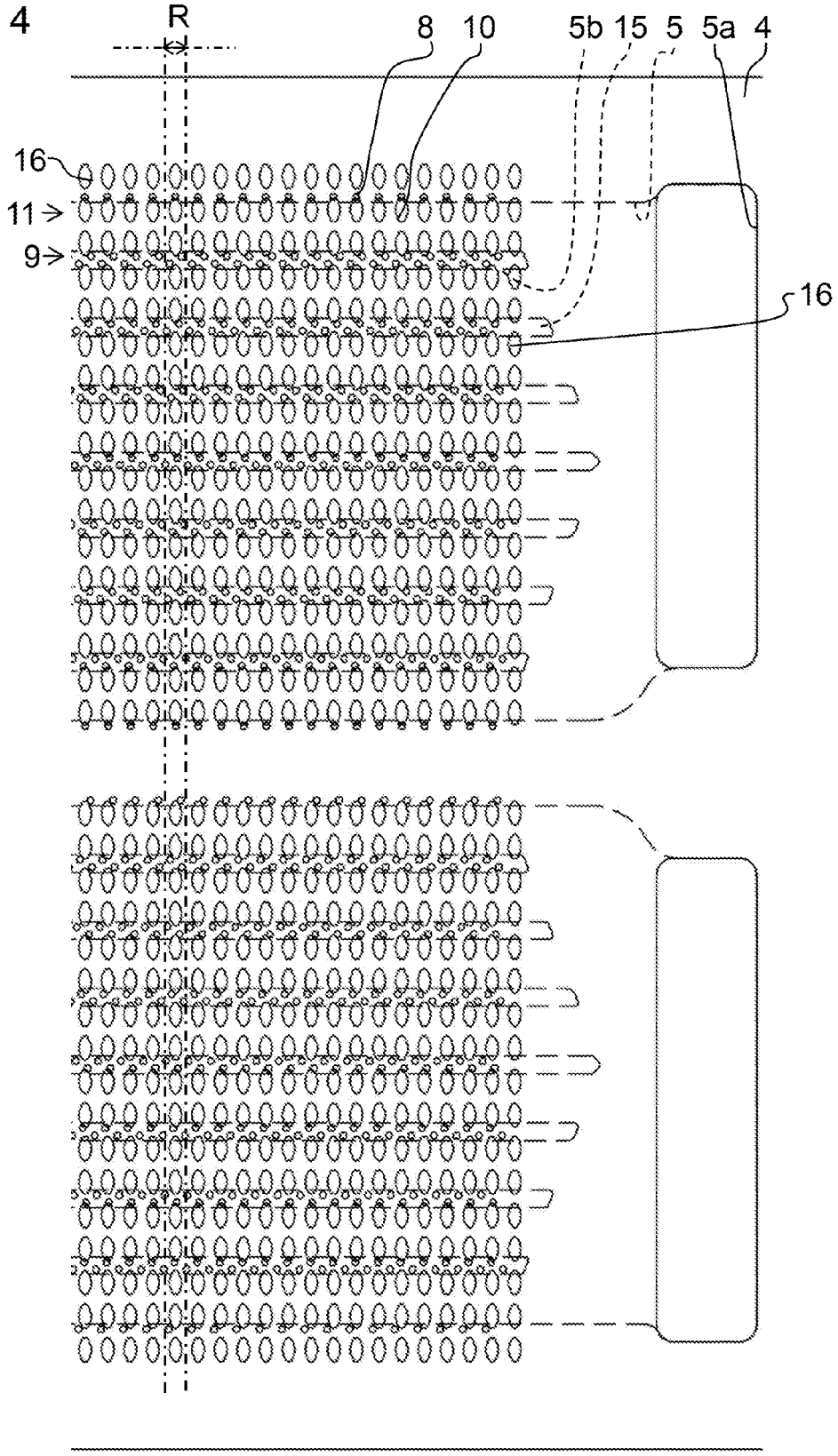
FIG. 4 is an enlarged view of the region enclosed by the dotted-chain line in FIG. 2, where some channels are omitted to simplify the description.
Figure 5:
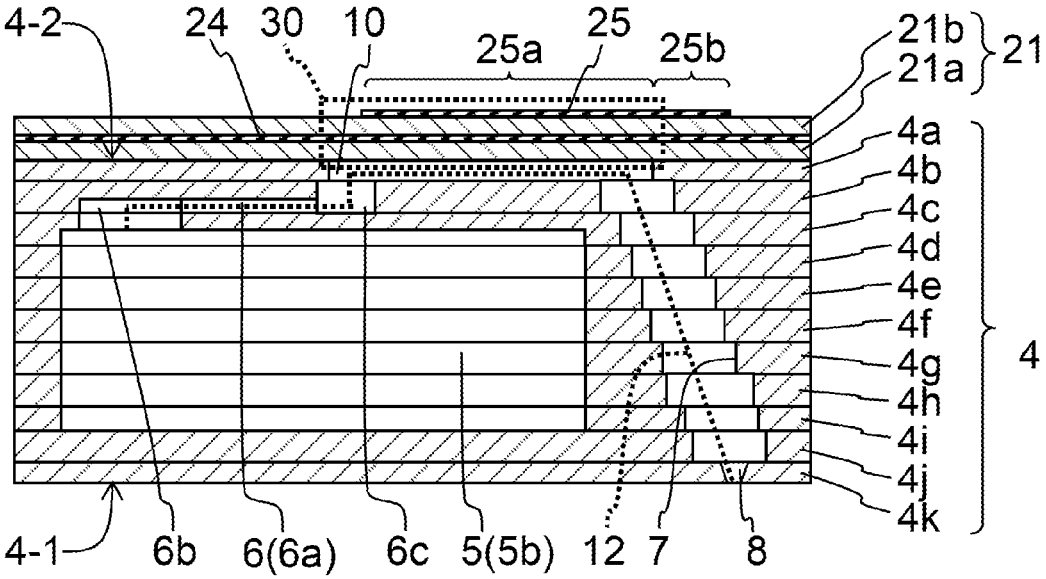
FIG. 5 is a longitudinal sectional view taken along line V-V in FIG. 3.
Figure 6:
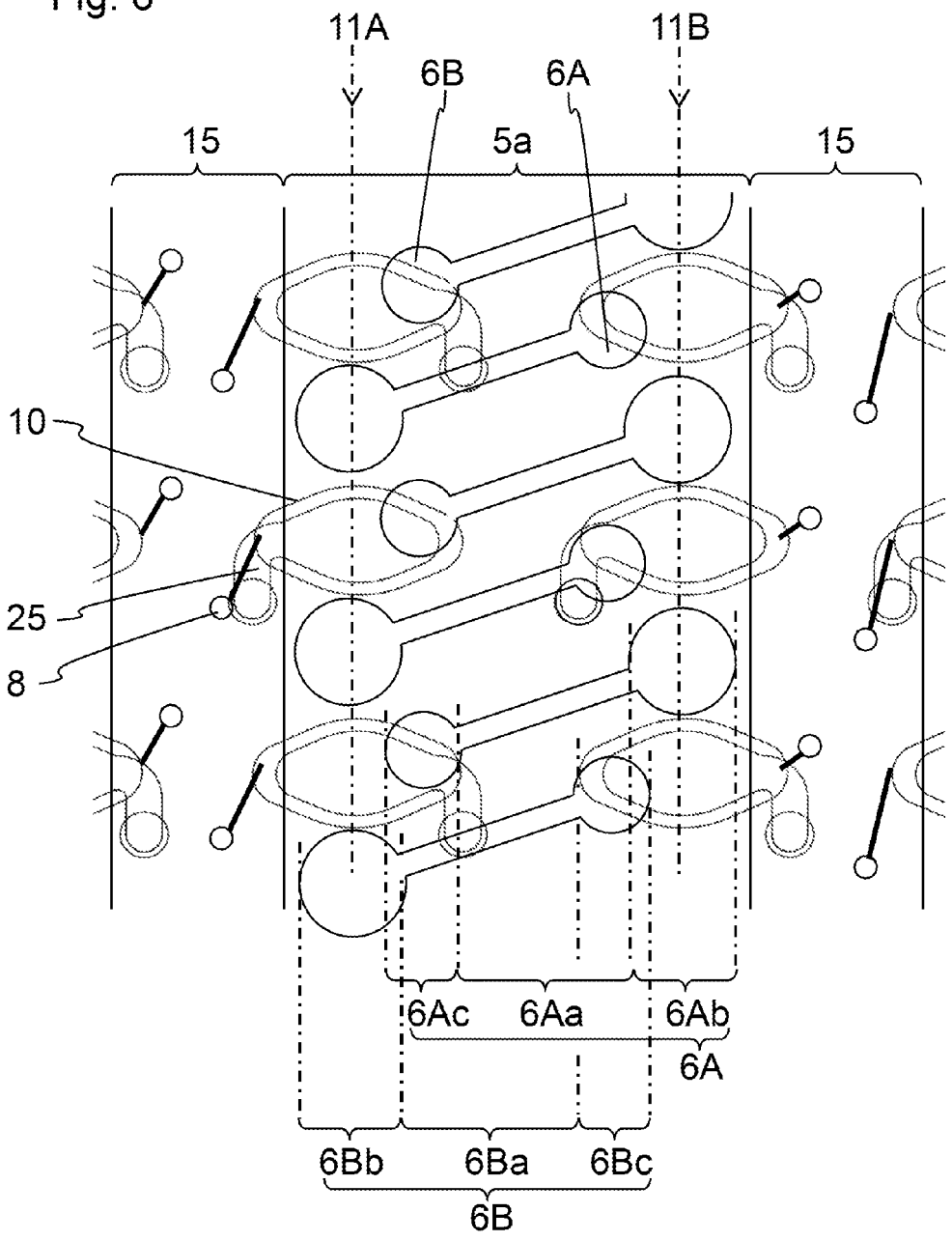
FIG. 6 is an enlarged plan view of a main portion of the head body illustrated in FIG. 2.
Figure 7:
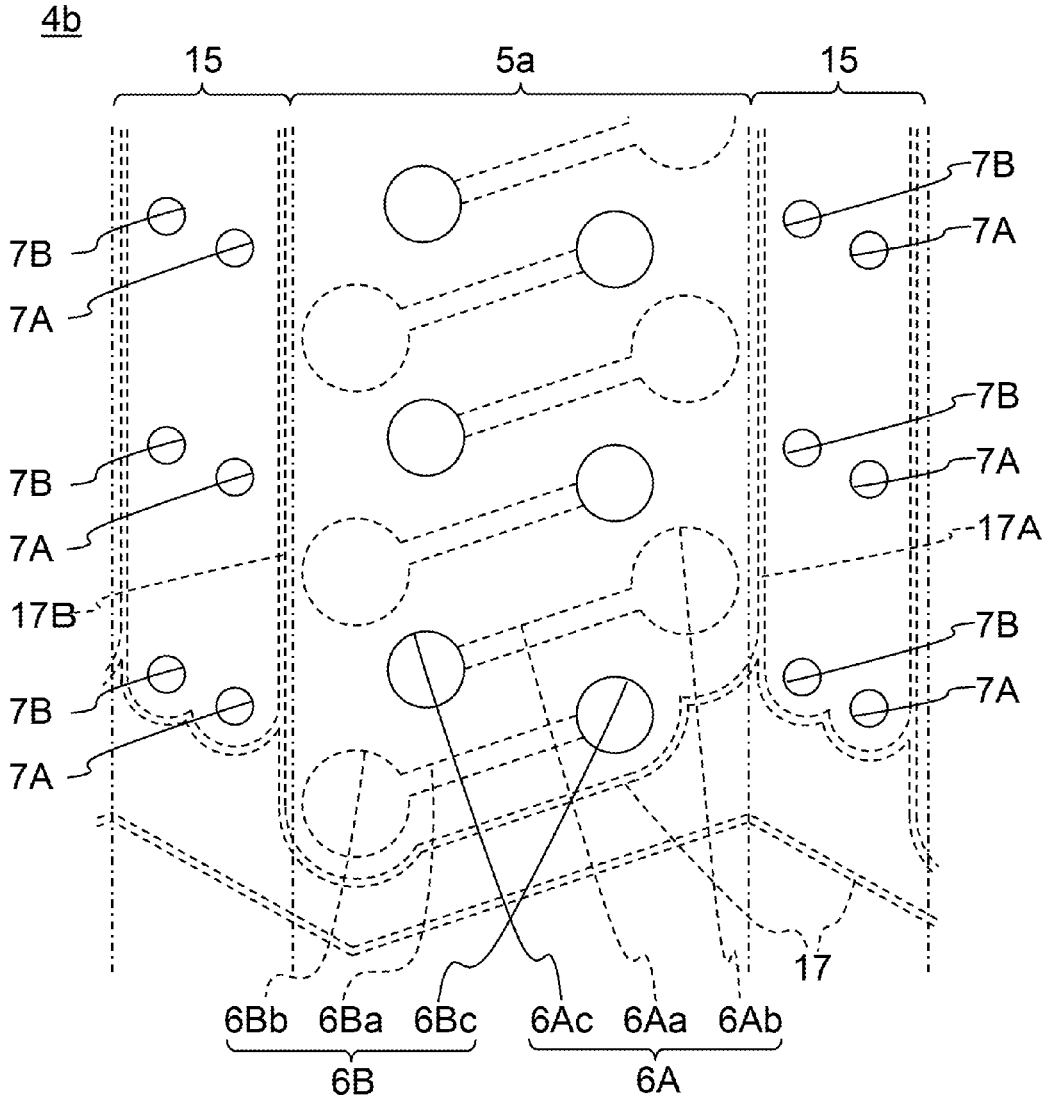
FIG. 7 is an enlarged plan view of a plate in the same region as the region illustrated in FIG. 6.

The liquid ejecting heads 2 according to the embodiment of the present invention will now be described. FIG. 2 is a plan view of a head body 2*a*, which is the main portion of each liquid ejecting head 2 illustrated in FIG. 1. FIG. 3 is an enlarged plan view of a portion of the head body 2*a* in the region enclosed by the dotted-chain line in FIG. 2. In FIG. 3, some channels are omitted to simplify the description. FIG. 4 is an enlarged plan view of the same portion as that in FIG. 3, where channels other than those omitted in FIG. 3 are omitted. FIG. 5 is a longitudinal sectional view taken along line V-V in FIG. 3. FIG. 6 is an enlarged plan view of a main portion of the head body 2*a* illustrated in FIG. 2. FIG. 7 is an enlarged plan view of a plate 4*b* in the same region as the region illustrated in FIG. 6. In FIGS. 3 and 4, compression chambers 10, restricting portions 6, ejection holes 8, etc., which are arranged below a piezoelectric actuator substrate 21 and therefore are to be drawn with broken lines, are drawn with solid lines to facilitate understanding of the drawing.

Each liquid ejecting head 2 may include a reservoir, which supplies the liquid to the head body 2*a*, and a housing in addition to the head body 2*a*. The head body 2*a* includes a channel member 4 and the piezoelectric actuator substrate 21 having displacement elements 30, which are compressing portions, formed therein.

The channel member 4 of the head body 2*a* includes manifolds 5 that serve as common channels, the compression chambers 10 connected to the manifolds 5, and the ejection holes 8 connected to the compression chambers 10. The compression chambers 10 open at the top surface of the channel member 4, and the top surface of the channel member 4 serves as a compression chamber surface 4-2. The top surface of the channel member 4 has openings 5*a* connected to the manifolds 5, and liquid is supplied to the manifolds 5 through the openings 5*a*.

The piezoelectric actuator substrate 21 including the displacement elements 30 is bonded to the top surface of the channel member 4 such that each displacement element 30 is arranged above the corresponding compression chamber 10. Signal transmission units 60 that supply signals to the displacement elements 30 are connected to the piezoelectric actuator substrate 21. In FIG. 2, to clearly illustrate the state in which two signal transmission units 60 are connected to the piezoelectric actuator substrate 21, the contours of the signal transmission units 60 in the regions around the portions that are connected to the piezoelectric actuator substrate 21 are shown by the dotted lines. Electrodes formed on the signal transmission units 60 and electrically connected to the piezoelectric actuator substrate 21 are arranged in a rectangular pattern at the ends of the signal transmission units 60. The two signal transmission units 60 are connected to the piezoelectric actuator substrate 21 such that the ends there of are in a central region of the piezoelectric actuator substrate 21 in the short-side direction.

The head body 2*a* includes the flat plate-shaped channel member 4. The head body 2*a* also includes a single piezoelectric actuator substrate 21 that is bonded to the channel member 4 and that includes the displacement elements 30. The piezoelectric actuator substrate 21 has a rectangular shape in plan view, and is arranged on the top surface of the channel member 4 such that the long sides of the rectangular shape extend in the long-side direction of the channel member 4.

Two manifolds 5 are formed in the channel member 4. The manifolds 5 have a long and narrow shape that extends from one end of the channel member 4 in the long-side direction toward the other end. In other words, the manifolds 5 are long in one direction. In the present embodiment, the one direction is the same as the long-side direction of the liquid ejecting head 2. Each manifold 5 has openings 5*a* that open at the top surface of the channel member 4 at both ends of the manifold 5.

Each manifold 5 is partitioned into sections by partition walls 15 at least in a central region thereof in the long-side direction, that is, a region in which the manifold 5 is connected to the compression chambers 10. The partition walls 15 are spaced from each other in the short-side direction. In the central region in the long-side direction, which is the region in which the manifold 5 is connected to the compression chambers 10, the partition walls 15 have the same height as that of the manifold 5 so that the manifold 5 is completely partitioned into a plurality of sub-manifolds 5*b*. Accordingly, the ejection holes 8 and channels extending from the ejection holes 8 to the compression chambers 10 can be formed so as to overlap the partition walls 15 in plan view.

The sections into which each manifold 5 is partitioned may be referred to as the sub-manifolds 5*b*. In the present embodiment, two independent manifolds 5 are provided, and each manifold 5 has the openings 5*a* at both ends thereof. Each manifold 5 has seven partition walls 15 that partition the manifold 5 into eight sub-manifolds 5*b*. The width of the sub-manifolds 5*b* is greater than that of the partition walls 15, so that the sub-manifolds 5*b* allow a large amount of liquid to flow therethrough.

The compression chambers 10 are arranged two dimensionally in the channel member 4. The compression chambers 10 are hollow spaces having a diamond shape with rounded corners or an elliptical shape in plan view.

Each compression chamber 10 is connected to one of the sub-manifolds 5*b* through the corresponding restricting portion 6. Two compression chamber rows 11 are arranged one on each side of each sub-manifold 5*b* so as to extend along the sub-manifold 5*b*, each compression chamber row 11 including compression chambers 10 that are connected to the sub-manifold 5*b*. Accordingly, 16 compression chamber rows 11 are provided for each manifold 5, and 32 compression chamber rows 11 are provided in total in the head body 2*a*. In each compression chamber row 11, the compression chambers 10 are arranged with constant intervals therebetween in the long-side direction, the intervals corresponding to, for example, 37.5 dpi.

The compression chamber rows 11 have dummy compression chambers 16 at the ends thereof so that the dummy compression chambers 16 form a dummy compression chamber line. The dummy compression chambers 16 belonging to the dummy compression chamber line are connected to the manifolds 5, but are not connected to the ejection holes 8. Also, a dummy compression chamber row in which the dummy compression chambers 16 are linearly arranged is provided at each outer side of the 32 compression chamber rows 11. The dummy compression chambers 16 belonging to the dummy compression chamber rows are not connected to the manifolds 5 or the ejection holes 8. Owing to the dummy compression chambers 16, the second compression chambers 10 from the edges have surrounding structures (rigidities) similar to those of the surrounding structures (rigidities) of the other compression chambers 10, so that differences in the liquid ejecting characteristics can be reduced. The influence of the differences between the surrounding structures is large for the compression chambers 10 arranged next to each other in the longitudinal direction, which are close to each other. For this reason, the dummy compression chambers are provided at both ends in the longitudinal direction. Since the influence is relatively small in the width direction, the dummy compression chambers are provided only at the sides close to the edges of the head body 21*a*. Accordingly, the width of the head body 21*a* can be reduced.

The compression chambers 10 connected to each manifold 5 are arranged in a grid pattern having rows and columns along the outer sides of the rectangular piezoelectric actuator substrate 21. Accordingly, individual electrodes 25, which are arranged above the compression chambers 10, are evenly spaced from the outer sides of the piezoelectric actuator substrate 21. Therefore, the piezoelectric actuator substrate 21 is not easily deformed when the individual electrodes 25 are formed. If the piezoelectric actuator substrate 21 is largely deformed when the piezoelectric actuator substrate 21 and the channel member 4 are bonded together, there is a risk that the displacement elements 30 near the outer sides will receive a stress and the displacement characteristics thereof will vary. The variation in the displacement characteristics can be reduced by reducing the deformation. The influence of the deformation is further reduced since the dummy compression chamber rows including the dummy compression chambers 16 are provided on the outer side of the compression chamber rows 11 that are closest to the outer sides of the piezoelectric actuator substrate 21. The compression chambers 10 belonging to each compression chamber row 11 are arranged with constant intervals therebetween, and the individual electrodes 25 that correspond to the compression chamber rows 11 are also arranged with constant intervals therebetween. The compression chamber rows 11 are arranged with constant intervals therebetween in the short-side direction, and the rows of the individual electrodes 25 corresponding to the compression chamber rows 11 are also arranged with constant intervals therebetween in the short-side direction. Accordingly, regions in which the influence of crosstalk, in particular, is significant may be eliminated.

Although the compression chambers 10 are arranged in a grid pattern in the present embodiment, they may instead be arranged in a staggered pattern in which the compression chambers 10 of each compression chamber row 11 are disposed between the compression chambers 10 of the adjacent compression chamber row 11. In this case, the distance between the compression chambers 10 belonging to the adjacent compression chamber rows 11 can be increased, so that crosstalk can be further reduced.

Irrespective of how the compression chamber rows 11 are arranged, crosstalk can be reduced by arranging the compression chambers 10 such that, in plan view of the channel member 4, the compression chambers 10 of each compression chamber row 11 do not overlap the compression chambers 10 of the adjacent compression chamber row 11 in the long-side direction of the liquid ejecting head 2. If the distances between the compression chamber rows 11 are increased, the width of the liquid ejecting head 2 is increased accordingly. As a result, the accuracy of the angle at which the liquid ejecting head 2 is attached to the printer 1 greatly affects the printing result. When multiple liquid ejecting heads 2 are used, the accuracy of the relative positions between the liquid ejecting heads 2 also greatly affects the printing result. The influence of these accuracies on the printing result can be reduced by setting the width of the partition walls 15 smaller than that of the sub-manifolds 5*b*.

The compression chambers 10 connected to each sub-manifold 5*b* form two compression chamber rows 11, and the ejection holes 8 connected to the compression chambers 10 belonging to each compression chamber row 11 form a single ejection hole row 9. The ejection holes 8 connected to the compression chambers 10 belonging to the two compression chamber rows 11 open at different sides of the sub-manifold 5*b*. Although two ejection hole rows 9 are provided on each partition wall 15 in FIG. 4, the ejection holes 8 belonging to each ejection hole row 9 are connected to the sub-manifold 5*b* adjacent to the ejection holes 8 through the compression chambers 10. When the ejection holes 8 connected to the adjacent sub-manifolds 5*b* through the compression chamber rows 11 are arranged so as not to overlap in the long-side direction of the liquid ejecting head 2, crosstalk between the channels that connect the compression chambers 10 to the ejection holes 8 can be suppressed. Thus, crosstalk can be further reduced. When the entireties of the channels that connect the compression chambers 10 to the ejection holes 8 do not overlap in the long-side direction of the liquid ejecting head 2, crosstalk can be further reduced.

The compression chambers 10 connected to each manifold 5 form a compression chamber group. Since there are two manifolds 5, two compression chamber groups are provided. The compression chambers 10 that contribute to ejection in the compression chamber groups are arranged in the same way at positions translated from one another in the short-side direction. The compression chambers 10 are arranged along the top surface of the channel member 4 over almost the entirety of the region that faces the piezoelectric actuator substrate 21, although there are regions in which the intervals between the compression chambers 10 are somewhat large, such as the region between the compression chamber groups. In other words, the compression chamber groups including the compression chambers 10 occupy a region having substantially the same shape as that of the piezoelectric actuator substrate 21. The open side of each compression chamber 10 is covered with the piezoelectric actuator substrate 21 that is bonded to the top surface of the channel member 4.

Each compression chamber 10 has a channel extending therefrom at a corner that opposes the corner at which the restricting portion 6 is connected to the compression chamber 10, the channel extending to the corresponding ejection hole 8 which opens in an ejection-hole surface 4-1 at the bottom of the channel member 4. The channel extends in a direction away from the compression chamber 10 in plan view. More specifically, the channel extends away from the compression chamber 10 in the diagonal direction of the compression chamber 10 while being shifted leftward or rightward relative to the diagonal direction. Accordingly, although the compression chambers 10 are arranged in a grid pattern such that the intervals therebetween in each compression chamber row 11 correspond to 37.5 dpi, the ejection holes 8 may be arranged with intervals corresponding to 1200 dpi over the entire region.

In other words, if the ejection holes 8 are projected onto a plane perpendicular to an imaginary straight line that is parallel to the long-side direction of the channel member 4, the 16 ejection holes 8 connected to each of the manifolds 5 in the region R enclosed by the imaginary straight lines in FIG. 4, that is, 32 ejection holes 8 in total, are arranged at constant intervals that correspond to 1200 dpi. This means that, when ink of the same color is supplied to both of the manifolds 5, an image can be formed at a resolution of 1200 dpi in the long-side direction. The 1 ejection holes 8 connected to each manifold 5 are arranged at constant intervals corresponding to 600 dpi in the region R enclosed by the imaginary straight lines in FIG. 4. Accordingly, when inks of different colors are supplied to the manifolds 5, a two-color image can be formed at a resolution of 600 dpi in the long-side direction. When two liquid ejecting heads 2 are used, a four-color image can be formed at a resolution of 600 dpi. In this case, the printing accuracy is higher than that achieved when four liquid ejecting heads capable of performing printing at 600 dpi are used, and print settings can be facilitated. The ejection holes 8 connected to the compression chambers 10 belonging to a single compression chamber line that extends in the short-side direction of the head body 2*a* cover the region R enclosed by the imaginary straight lines.

The individual electrodes 25 are formed on the top surface of the piezoelectric actuator substrate 21 at positions where the individual electrodes 25 face the corresponding compression chambers 10. Each individual electrode 25 is somewhat smaller than the corresponding compression chamber 10, and includes an individual electrode body 25*a* having a shape that is substantially similar to that of the compression chamber 10 and a lead electrode 25*b* that extends from the individual electrode body 25*a*. Similar to the compression chambers 10, the individual electrodes 25 also form individual electrode rows and individual electrode groups. Common-electrode surface electrodes 28 are also formed on the top surface of the piezoelectric actuator substrate 21. The common-electrode surface electrodes 28 are electrically connected to a common electrode 24 by through conductors (not illustrated) formed in a piezoelectric ceramic layer 21*b*.

The ejection holes 8 are located outside the regions that face the manifolds 5 arranged at the bottom side of the channel member 4. Also, the ejection holes 8 are arranged in a region facing the piezoelectric actuator substrate 21 at the bottom side of the channel member 4. The ejection holes 8 occupy a region having substantially the same shape as that of the piezoelectric actuator substrate 21 as a single group. Liquid droplets are ejected from the ejection holes 8 when the corresponding displacement elements 30 of the piezoelectric actuator substrate 21 are displaced.

The channel member 4 includes a plurality of plates that are bonded to each other with an adhesive. In other words, the channel member 4 has a multilayer structure in which multiple plates are stacked and bonded together. The plates include a cavity plate 4*a*, an aperture (restricting portion) plate 4*b*, a supply plate 4*c*, manifold plates 4*d* to 4*i*, a cover plate 4*j*, and a nozzle plate 4*k* in that order from the top of the channel member 4. Multiple holes are formed in these plates. Each plate has a thickness of about 10 μm to 300 μm, so that high-precision holes can be formed. The channel member 4 has a thickness of about 500 μm to 2 mm. The plates are positioned relative to each other and stacked together so that the holes formed therein communicate with each other so as to form individual channels 12 and the manifolds 5. The head body 2*a* is configured such that the compression chambers 10 are formed in the top surface of the channel member 4, the manifolds 5 are formed in the channel member 4 at the bottom side of the channel member 4, and the ejection holes 8 are formed in the bottom surface of the channel member 4. Portions that form the individual channels 12 are arranged near each other at different locations so that the manifolds 5 are connected to the ejection holes 8 through the compression chambers 10.

The holes formed in each plate will now be described. The holes include the following first to fourth holes. The first holes are the compression chambers 10 formed in the cavity plate 4*a*. The second holes are communication holes that constitute the restricting portions 6, each of which connects one end of the corresponding compression chamber 10 to the corresponding manifold 5. These communication holes are formed in each of the aperture plate 4*b* (specifically, the inlets of the compression chambers 10) and the supply plate 4*c* (specifically, the outlets of the manifolds 5). The restricting portions 6 will be described below.

The third holes are descenders 7, which are portions of the channels that extend from the ends of the compression chambers 10 opposite the ends connected to the restricting portions 6 to the ejection holes 8. The descenders 7 are formed in each of the plates from the base plate 4*b* (specifically, the outlets of the compression chambers 10) to the nozzle plate 4*l* (specifically, the ejection holes 8).

The fourth holes are communication holes that constitute the sub-manifolds 5*a*. These communication holes are formed in the manifold plates 4*e* to 4*j*. The holes are formed in the manifold plates 4*e* to 4*j* so that partitioning portions that form the partition walls 15 remain so as to define the sub-manifolds 5*b*. The partitioning portions of the manifold plates 4*e* to 4*j* are connected to the manifold plates 4*e* to 4*j* by half-etched support portions (not illustrated).

The first to fourth communication holes are connected to each other to form the individual channels 12 extending from the inlets through which the liquid is supplied form the manifolds 5 (outlets of the manifolds 5) to the ejection holes 8. The liquid supplied to the manifolds 5 is ejected from each ejection hole 8 along the following path. First, the liquid flows upward from the corresponding manifold 5 to one end of the corresponding restricting portion 6. Next, the liquid flows horizontally in the extending direction of the restricting portion 6 to the other end of the restricting portion 6. Then, the liquid flows upward toward one end of the corresponding compression chamber 10. Then, the liquid flows horizontally in the extending direction of the compression chamber 10 to the other end of the compression chamber 10. The liquid enters the corresponding descender 7 from the compression chamber 10 and flows mainly downward while moving also in the horizontal direction. Then, the liquid reaches the ejection hole 8 that opens in the bottom surface, and is ejected outward.

The piezoelectric actuator substrate 21 has a multilayer structure including two piezoelectric ceramic layers 21*a* and 21*b* composed of piezoelectric materials. Each of the piezoelectric ceramic layers 21*a* and 21*b* has a thickness of about 20 μm. The thickness of the piezoelectric actuator substrate 21 from the bottom surface of the piezoelectric ceramic layer 21*a* to the top surface of the piezoelectric ceramic layer 21*b* is about 40 μm. Each of the piezoelectric ceramic layers 21*a* and 21*b* extends over the compression chambers 10. The piezoelectric ceramic layers 21*a* and 21*b* are made of a ferroelectric ceramic material, such as a lead zirconate titanate (PZT) based, $NaNbO_3$ based, $BaTiO_3$ based, (BiNa)$NbO_3$ based, or $BiNaNb_5O_{15}$ based ceramic material. The piezoelectric ceramic layer 21*a* serves as a vibration substrate, and is not necessarily composed of a piezoelectric material. The piezoelectric ceramic layer 21*a* may be replaced by, for example, a ceramic layer that is not composed of a piezoelectric material or a metal plate.

The piezoelectric actuator substrate 21 includes the common electrode 24 made of a metal material such as a Ag—Pd-based material, and the individual electrodes 25 made of a metallic material such as a Au-based material. The common electrode 24 has a thickness of about 2 μm, and the individual electrodes 25 have a thickness of about 1 μm.

The individual electrodes 25 are formed on the top surface of the piezoelectric actuator substrate 21 at positions where the individual electrodes 25 face their respective compression chambers 10. Each individual electrode 25 is somewhat smaller than a compression chamber body 10*a* in plan view, and includes an individual electrode body 25*a* having a shape that is substantially similar to that of the compression chamber body 10*a* and a lead electrode 25*b* that extends from the individual electrode body 25*a*. A connecting electrode 26 is provided on an end portion of the lead electrode 25*b* that extends away from the region facing the compression chamber 10. The connecting electrode 26 is formed of a conductive resin containing conductive powder, such as silver powder, and has a thickness of about 5 μm to 200 μm. The connecting electrode 26 is electrically bonded to a corresponding one of the electrodes provided on the signal transmission units 60.

Drive signals are supplied to the individual electrodes 25 from the control unit 88 through the signal transmission units 60. This will be described in detail below. The drive signals are supplied at a constant period in synchronization with the conveyance speed of the print medium P.

The common electrode 24 is arranged between the piezoelectric ceramic layer 21*b* and the piezoelectric ceramic layer 21*a* so as to extend over almost the entire surfaces thereof in the planar direction. In other words, the common electrode 24 extends so as to cover all of the compression chambers 10 within the region that faces the piezoelectric actuator substrate 21. The common electrode 24 is connected to the common-electrode surface electrodes 28 by the through conductors that extend through the piezoelectric ceramic layer 21*b*. The common-electrode surface electrodes 28 are formed on the piezoelectric ceramic layer 21*b* at locations separated from the electrode groups of the individual electrodes 44. The common electrode 24 is grounded by the common-electrode surface electrodes 28, and is maintained at the ground potential. Similar to the individual electrodes 25, the common-electrode surface electrodes 28 are directly or indirectly connected to the control unit 88.

Portions of the piezoelectric ceramic layer 21*b* that are interposed between the individual electrodes 25 and the common electrode 24 are polarized in the thickness direction, and serve as displacement elements 30 having a unimorph structure that are displaced when a voltage is applied to the individual electrodes 25. More specifically, when the individual electrodes 25 and the common electrode 24 are set to different potentials to apply an electric field to the piezoelectric ceramic layer 21*b* in the direction of polarization thereof, the portions to which the electric field is applied function as active portions that are deformed due to the piezoelectric effect. When the control unit 88 sets the individual electrodes 25 to a predetermined positive or negative potential relative to the potential of the common electrode 24 so that the direction of the electric field is the same as the direction of polarization, the portions of the piezoelectric ceramic layer 21*b* interposed between the electrodes (active portions) contract in the planar direction. Conversely, the piezoelectric ceramic layer 21*a*, which is an inactive layer, is not affected by the electric field, and therefore does not contract by itself but tries to restrict the deformation of the active portions. As a result, the piezoelectric ceramic layer 21*a* and the piezoelectric ceramic layer 21*b* are deformed by different amounts in the direction of polarization, so that the piezoelectric ceramic layer 21*a* is deformed so as to be convex toward the compression chambers 10.

The liquid ejection operation will now be described. The displacement elements 30 are driven (displaced) in response to drive signals supplied to the individual electrodes 25 under the control of the control unit 88. The liquid ejection operation can be performed by using various types of drive signals in the present embodiment; here, a so-called pulling driving method will be described.

The individual electrodes 25 are initially set to a potential higher than that of the common electrode 24 (hereafter referred to as a "high potential"). The potential of each individual electrode 25 is temporarily reduced to that of the common electrode 24 (hereafter referred to as a "low potential") every time an ejection request is issued, and is then returned to the high potential at a predetermined timing. Accordingly, the piezoelectric ceramic layers 21*a* and 21*b* return to their original flat shape at the time when the individual electrode 25 is set to the low potential, and the volume of the corresponding compression chamber 10 increases from that in the initial state (state in which the individual and common electrodes are set to different potentials). Therefore, a negative pressure is applied to the liquid in the compression chamber 10. As a result, the liquid in the compression chamber 10 starts to vibrate at its natural vibration period. More specifically, first, the volume of the compression chamber 10 starts to increase, and the negative pressure gradually decreases. Then, the volume of the compression chamber 10 reaches a maximum volume, and the pressure decreases to approximately zero. Then, the volume of the compression chamber 10 starts to decrease, and the pressure starts to increase. The individual electrode 25 is set to the high potential substantially when the pressure reaches a maximum pressure. Accordingly, the vibration applied first and the vibration applied next are combined so that a larger pressure is applied to the liquid. The pressure is transmitted through the corresponding descender 7, so that the liquid is ejected from the corresponding ejection hole 8.

Thus, a liquid droplet can be ejected by applying a pulse driving signal to the individual electrode 25, the driving signal being set basically to the high potential and to the low potential for a predetermined period. In principle, the liquid ejection speed and the amount of ejection can be maximized by setting the pulse width to an acoustic length (AL), which is half the natural vibration period of the liquid in the compression chamber 10. The natural vibration period of the liquid in the compression chamber 10 depends greatly on the properties of the liquid and the shape of the compression chamber 10, but it depends also on the properties of the piezoelectric actuator substrate 21 and the properties of the channels connected to the compression chamber 10.

The pulse width is set to a value that is about 0.5 AL to 1.5 AL in practice because of other factors to be taken into consideration, for example, to eject the liquid in the form of a single droplet. Since the amount of ejection can be reduced by setting the pulse width to a value different from AL, the pulse width may be set to a value different from AL for the purpose of reducing the amount of ejection.

The restricting portion 6 connecting the compression chamber 10 to the corresponding sub-manifold 5*a*, which is a common channel, has a high channel resistance so as to reflect pressure waves in the pulling driving method. Therefore, the restricting portion 6 directly affects the ejection characteristics, such as the ejection speed and the amount of ejection. The pressure waves are reflected also when the liquid is ejected by a pushing method or other methods. The pressure waves are attenuated in the compression chamber 10 and the descender 7 but remain as residual waves and affect the subsequent ejection. In any case, the channel characteristics of the restricting portion 6 greatly affect the ejection characteristics, and therefore dimensional variations of the restricting portion 6 are preferably small.

The pressure applied to the compression chamber 10 by the corresponding displacement element 30 is transmitted toward the restricting portion 6 and the descender 7. The restricting portion 6 is generally configured to have a channel resistance higher than that of the descender 7 so that the energy is used mainly for the ejection. In particular, when the ejection is performed by the pulling driving method, the restricting portion 6 is configured to have a high channel resistance so that the reflection easily occurs.

The channel resistance of a channel can be increased by increasing the length of the channel or reducing the cross-sectional area of the channel. When the length of the channel is increased, the size of the head body 2*a* is also increased. Therefore, it is necessary to reduce the cross-sectional area of the channel.

Accordingly, a restricting-portion body 6*a*, which is a part of each restricting portion 6 that has a high channel resistance, is formed of a channel that extends parallel to the planes of the plates, that is, in a direction perpendicular to a stacking direction in which the plates are stacked. Thus, the cross-sectional area can be reduced and the length can be somewhat increased.

When the restricting-portion body 6*a*, which extends parallel to the planes of the plates, is directly connected to the corresponding compression chamber 10, which is shaped so as to extend in a planar direction of the plates, displacements of the plates cause large variations in the lengths of the channels through which the liquid flows in practice. Accordingly, an outlet 6*c*, which is a hole that extends in the stacking direction of the plates, is provided at the compression-chamber-10 side of the restricting-portion body 6*a* so that the restricting-portion body 6*a* and the compression chamber 10 are connected to each other through the outlet 6*c*. Similarly, the restricting-portion body 6*a* and the corresponding sub-manifold 5*a* are connected to each other with an inlet 6*b*, which is also a hole that extends in the stacking direction of the plates.

The detailed arrangement of the restricting portions 6 will be described with reference to FIG. 6. In FIG. 6, the shapes of the descenders 7 that connect the compression chambers 10 to the ejection holes 8 are not illustrated, and only the connections are indicated by lines. Two compression chamber rows 11, which are rows of the compression chambers 10, are arranged one on each side of the sub-manifold 5*a* so as to extend along the sub-manifold 5*a*. In FIG. 6, the compression chamber row 11 on the left side of the sub-manifold 5*a* is defined as a first compression chamber row 11A, and the compression chamber row 11 on the right side of the sub-manifold 5*a* is defined as a second compression chamber row 11B. The direction perpendicular to the direction in which the sub-manifold 5*a* extends (one direction), that is, the left-right direction in FIG. 6, is defined as other direction. In FIG. 6, the right side is defined as one side in the other direction, and the left side is defined as other side in the other direction.

The compression chambers 10 belonging to the first compression chamber row 11A are connected to the sub-manifold 5*a* by first restricting portions 6A. Each first restricting portion 6A includes a first inlet 6Ab, a first restricting-portion body 6Aa, and a first outlet 6Ac in that order from the sub-manifold 5*a*. The compression chambers 10 belonging to the second compression chamber row 11B are connected to the sub-manifold 5*a* by second restricting portions 6B. Each second restricting portion 6B includes a second inlet 6Bb, a second restricting-portion body 6Ba, and a second outlet 6Bc in that order from the sub-manifold 5*a*.

The first restricting-portion bodies 6Aa and the second restricting-portion bodies 6Ba are channels through which the liquid flows in a planar direction of the plates. The first restricting-portion bodies 6Aa and the second restricting-portion bodies 6Ba are formed of grooves in the bottom surface of the plate 4*b*. More specifically, the channels are formed by covering the grooves with the top surface of the plate 4*c*. The first restricting-portion bodies 6Aa and the second restricting-portion bodies 6Ba are linear channels having a substantially constant width. The first restricting-portion bodies 6Aa and the second restricting-portion bodies 6Ba extend in a direction that crosses the one direction, and are alternately arranged in the one direction. The angle between the one direction and the direction in which the first restricting-portion bodies 6Aa and the second restricting-portion bodies 6Ba extend is preferably 45 degrees or more so that the restricting portions 6 can be densely arranged. More preferably, the angle is 60 or more, and still more preferably, 75 degrees or more.

The first inlets 6Ab are columnar channels through which the liquid flows in the stacking direction of the plates and which extend from the top surfaces of the grooves in the plate 4*b* to the bottom surface of the plate 4*c*. The first outlets 6Ac are connected to the first restricting-portion bodies 6Aa at the ends adjacent to the compression chambers 10. The first outlets 6Ac are columnar channels through which the liquid flows in the stacking direction of the plates and which extend from the top surface of the plate 4*b* to the bottom surface of the plate 4*b*. The first inlets 6Ab are connected to the first restricting-portion bodies 6Aa at the ends adjacent to the sub-manifold 5*a*. Thus, the plate 4*b* includes the first restricting-portion bodes 6Aa having a linear shape; the first outlets 6Ac, each of which is connected to one end of the corresponding first restricting-portion body 6Aa and has an opening width greater than that of the first restricting-portion bodies 6Aa; and the first inlets 6Ab, each of which is connected to the other end of the corresponding first restricting-portion body 6Aa and has an opening width greater than that of the first restricting-portion bodies 6Aa. In the second restricting portions 6B, the second restricting-portion bodies 6Ba, the second inlets 6Bb, and the second outlets 6Bc are arranged in a similar manner.

When the plate 4*b* and the plate 4*c* are stacked and bonded together, there is a risk that an adhesive applied therebetween will flow into the first restricting portions 6A and the second restricting portions 6B. However, since the first restricting portions 6A and the second restricting portions 6B are alternately arranged substantially parallel to each other, they serve as adhesive receiving grooves for each other, thereby reducing the amount of adhesive that flows into the other restricting portions. Specifically, since the second restricting portions 6B are arranged on both sides of the first restricting portions 6A, hardy any adhesive flows beyond the second restricting portions 6B and into the first restricting portions 6A. Even when an excessive amount of adhesive is supplied to the regions between the first restricting portions 6A and the second restricting portions 6B, the first restricting portions 6A and the second restricting portions 6B evenly receive approximately half of the adhesive. Thus, the amount of adhesive that flows into the first restricting portions 6A and the second restricting portions 6B can be reduced.

The adhesive that flows into the first outlets 6Ac will now be described. Since each first outlet 6Ac is disposed between two adjacent second restricting portions 6B, the amount of adhesive that flows into the first outlets 6Ac from above and below in FIG. 6 can be reduced by the second restricting portions 6B. In the other direction, that is, in the left-right direction in FIG. 6, the two adjacent second restricting portions 6B extend rightward in FIG. 6 beyond the position of the first outlets 6Ac. Therefore, the amount of adhesive that flows into the first outlets 6Ac from the right side in FIG. 6 can also be reduced by the restricting portions 6B. The second inlets 6Bb are on the other side of the first outlets 6Ac in the other direction (that is, on the left side in the left-right direction in FIG. 6). The second inlets 6Bb have an opening width greater than that of the first outlets 6Ac. Therefore, part of the adhesive that flows toward the first outlets 6Ac from the left side in FIG. 6 is received by the second inlets 6Bb and does not easily flow into the first outlets 6Ac.

Here, the "opening width" of a hole is a diameter of the hole in plan view of the plates. When the hole is not circular and is, for example, rectangular in plan view, the "opening width" means the maximum diameter, that is, the length of the long sides that connect the opposing short sides.

The expression the second inlets 6Bb have an opening width greater than that of the first outlets 6Ac" includes a case where the opening width is increased due to manufacturing errors. In addition, the expression the second inlets 6Bb have an opening width greater than that of the first outlets 6Ac" means that it is not necessary that all of the second inlets 6Bb and the first outlets 6Ac satisfy this relationship as long as some of them satisfy this relationship. In other words, it is sufficient if one of the second inlets 6Bb has an opening width greater than that of one of the first outlets 6Ac that is adjacent thereto. Preferably, all of the second inlets 6Bb and the first outlets 6Ac satisfy the above-described relationship.

The above description applies also to the relationship between the first inlets 6Ab and the second outlets 6Bc.

The first outlets 6Ac are preferably arranged between the second restricting-portion bodies 6Ba. With this arrangement, the second inlets 6Bb are on the other side of the first outlets 6Ac in the other direction, and the amount of adhesive that flows into the first outlets 6Ac from the left side in FIG. 6 can be further reduced.

The above description also applies to the second outlets 6Bc. More specifically, the first inlets 6Ab are arranged on the one side of the second outlets 6Bc in the other direction, (that is, on the right side in the left-right direction in FIG. 6). The first inlets 6Ab have an opening width greater than that of the second outlets 6Bc. Therefore, part of the adhesive that flows toward the second outlets 6Bc from the right side in FIG. 6 is received by the first inlets 6Ab and does not easily flow into the second outlets 6Bc.

The second outlets 6Bc are preferably arranged between the first restricting-portion bodies 6Aa. With this arrangement, the first inlets 6Ab are on the one side of the second outlets 6Bc in the other direction, and the amount of adhesive that flows into the second outlets 6Bc from the right side in FIG. 6 can be further reduced.

The restricting-portion body 6*a* of each restricting portion 6 is a portion that has a high channel resistance, and mainly serves a function of reflecting the pressure waves transmitted from the corresponding compression chamber 10. The outlet 6*c* has a large cross-sectional area in the direction in which the liquid flows, and has a channel resistance lower than that of the restricting-portion body 6*a*. Therefore, even when the channel resistance of the outlet 6*c* varies, the influence on the channel resistance of the entire restricting portion 6 is relatively small. From this viewpoint, the cross-sectional area of the outlet 6*c* is preferably increased. However, if the outlet 6*b* is broader than the compression chamber 10 and the restricting-portion body 6*a*, the liquid easily stagnates in the broad portions. Such stagnation easily leads to the adhesion of a solid content in the liquid, and is preferably avoided. In other words, it is not preferable to increase the size of the outlet 6*c* without consideration.

In contrast, even when the size of the inlet 6*b* is increased, the above-described stagnation does not easily occur since the inlet 6*b* is connected to the sub-manifold 5*a*, which is larger than the inlet 6*b*. Accordingly, the size of the inlet 6*b* is increased, that is, the opening width of the inlet 6*b* is increased to reduce the width of the path along which the adhesive flows into the outlet 6*c*. Thus, variations in the channel resistance of the outlet 6*c* can be reduced.

The holes that constitute the first restricting-portion bodies 6Aa and the second restricting-portion bodies 6Ba may be formed in a single plate. In such a case, the upper sides of the holes are covered with the bottom surface of the plate stacked thereabove, and the lower sides of the holes are covered with the top surface of the plate stacked therebelow. When the displacements between the plates are taken into consideration, the first restricting-portion bodies 6Aa and the second restricting-portion bodies 6Ba are preferably constituted by grooves or holes in a single plate. This is because, in such a case, variations in the channel characteristics due to the displacements between the plates are less likely to occur than in the case where the first restricting-portion bodies 6Aa and the second restricting-portion bodies 6Ba are formed by combining grooves or holes formed in a plurality of plates together.

The first restricting-portion bodies 6Aa and the second restricting-portion bodies 6Ba are preferably formed of grooves as described above. If they are formed of holes, the adhesive flows into the holes from two adhesive layers when the plate with the holes is stacked between plates disposed thereabove and therebelow. However, if the first restricting-portion bodies 6Aa and the second restricting-portion bodies 6Ba are formed of grooves, the adhesive flows into the grooves from only from one adhesive layer when the plate with the grooves is stacked on a plate that covers the grooves. The adhesive is preferably supplied to the principal surface in which the grooves are formed. This is because, in such a case, the possibility that the adhesive will be directly supplied to the inner spaces of the grooves in the stacking process can be reduced. In addition, the possibility that the adhesive will be directly supplied to the principal surface of the plate that covers the grooves in the stacking process can also be reduced.

Preferably, a portion of each first restricting-portion body 6Aa having a length greater than or equal to half of the length of the first restricting-portion body 6Aa is disposed between two adjacent second restricting-portion bodies 6Ba. With this arrangement, the inflow of the adhesive supplied to the region between the two second restricting-portion bodies 6Ba can be stabilized, and therefore the variations in the channel resistance can be reduced. Similarly, preferably, a portion of each second restricting-portion body 6Ba having a length greater than or equal to half of the length of the second restricting-portion body 6Ba is disposed between two adjacent first restricting-portion bodies 6Aa. With this arrangement, the inflow of the adhesive supplied to the region between the two first restricting-portion bodies 6Aa can be stabilized, and therefore the variations in the channel resistance can be reduced.

More specifically, preferably, a portion of each first restricting-portion body 6Aa having a length greater than or equal to two-thirds of the length of the first restricting-portion body 6Aa is disposed between two adjacent second restricting portions 6B. With this arrangement, the inflow of the adhesive supplied to the region between the two second restricting portions 6B is further stabilized, and therefore the variations in the channel resistance can be further reduced. Similarly, preferably, a portion of each second restricting-portion body 6Ba having a length greater than or equal to two-thirds of the length of the second restricting-portion body 6Ba is disposed between two adjacent first restricting portions 6A. With this arrangement, the inflow of the adhesive supplied to the region between the two first restricting portions 6A is further stabilized, and therefore the variations in the channel resistance can be further reduced. More preferably, the entirety of each first restricting-portion body 6Aa is disposed between the two adjacent second restricting portions 6B, and the entirety of each second restricting-portion body 6Ba is disposed between the two adjacent first restricting portions 6A.

The opening of each inlet 6*b* at the side adjacent to the corresponding sub-manifold 5*a* is preferably disposed in the top surface of the sub-manifold 5*a*. The top surface of the sub-manifold 5*a* having the opening is preferably defined by a groove in the bottom surface of the plate 4*c*. With this arrangement, the risk that the adhesive supplied to the space between the plate 4*c* and the plate 4*d* will flow into the inlet 6*b* can be reduced.

Preferably, the top surface of the sub-manifold 5*a* is defined by a groove in the bottom surface of the plate 4*c*, and each restricting-portion body 6*a* is formed of a groove in the bottom surface of the plate 4*b*. In such a case, the entirety of each restricting portion 6 including the inlet 6*b* and the outlet 6*c* can be formed by stacking two plates, which are the plates 4*b* and 4*c*, together, and therefore the number of adhesive layers from which the adhesive may flow into the restricting portion 6 can be reduced.

Adhesive receiving grooves 17 arranged around the restricting portions 6 will now be described with reference to FIG. 7. FIG. 7 is an enlarged plan view of the plate 4*b*, in which grooves that constitute the restricting-portion bodies 6*a* are arranged, in the same region as the region illustrated in FIG. 6.

The plate 4*b* includes the following holes and grooves. That is, grooves that constitute the first restricting-portion bodies 6Aa and the second restricting-portion bodies 6Ba are arranged in the bottom surface of the plate 4*b*. Grooves that constitute portions of the first inlets 6Ab and grooves that constitute portions of the second inlet 6Bb are also arranged in the bottom surface of the plate 4*b*. The first inlets 6Ab and the second inlets 6Bb are formed by connecting these grooves to holes in the plate 4*c*. Holes that constitute the first outlets 6Ac and holes that constitute the second outlets 6Bc are arranged so as to extend through the plate 4*b*.

Holes that constitute portions of first descenders 7A that connect the compression chambers 10 belonging to the first compression chamber row 11A to the ejection holes 8 are arranged so as to extend through the plate 4*b* (these holes are hereinafter sometimes referred to simply as first descenders 7A). Holes that constitute portions of second descenders 7B that connect the compression chambers 10 belonging to the second compression chamber row 11B to the ejection holes 8 are also arranged so as to extend through the plate 4*b* (these holes are hereinafter sometimes referred to simply as second descenders 7B).

The adhesive receiving grooves 17 are also arranged in the bottom surface of the plate. The receiving grooves 17 include a first receiving groove 17A and a second receiving groove 17B, which will be described below.

The first inlets 6Ab are aligned in the one direction at an end of the region inside the sub-manifold 5*a* at the right side in FIG. 7 (that is, at the one side in the other direction). The second descenders 7B are aligned in the one direction at a location on the one side of the sub-manifold 5*a* in the other direction. The first receiving groove 17A, which extends in the one direction, is disposed between the first inlets 6Ab and the second descenders 7B. The first receiving groove 17A prevents the adhesive from flowing into the first inlets 6Ab from the right side in FIG. 7, and prevents the adhesive from flowing into the second descenders 7B from the left side in FIG. 7.

The first receiving groove 17A is disposed so as not to overlap the sub-manifold 5*a*, that is, so as to overlap the corresponding partition wall 15. Although portions located outside the outermost sub-manifolds 5*a* are not partition walls, substantially solid portions including those portions in which no sub-manifold 5*a* is formed and which only includes small holes and grooves, such as the descenders 7 and the receiving grooves 17, are also referred to as the partition walls 15 for convenience.

The bonding conditions differ between the regions that overlap the sub-manifolds 5*a* and the regions that do not overlap the sub-manifolds 5*a*. In the regions that overlap the partition walls 15, the pressure applied in the stacking process is easily transmitted, so that a high pressure is applied and the adhesion strength is increased. In contrast, in the regions that overlap the sub-manifolds 5*a*, the pressure is not easily transmitted and the bonding strength is weak. Since the applied pressure is higher in the regions that overlap the partition walls 15, even when the adhesive is uniformly applied, the adhesive easily flows from the regions that overlap the partition walls 15 toward the regions that overlap the sub-manifolds 5*a* in the bonding process.

The first receiving groove 17A prevents the thus-generated flow of the adhesive from reaching the first inlets 6Ab. However, when the adhesion areas around the first inlets 6Ab are provided only in the region that overlaps the sub-manifold 5*a*, the adhesion strength is relatively weak and liquid leakage or the like easily occurs. In particular, the adhesion areas on the right side of the first inlets 6Ab in FIG. 7 are small, and liquid leakage or the like easily occurs.

Therefore, the first receiving groove 17A is disposed in a region that does not overlap the sub-manifold 5*a*. With such an arrangement, the adhesion areas around the first inlets 6Ab, in particular, portions of the adhesion areas on the right side in FIG. 7, are disposed in a region that overlaps the partition wall 15, so that the adhesion strength is increased and liquid leakage can be suppressed.

Similarly, the second receiving groove 17B, which extends in the one direction, is disposed between the second inlets 6Bb and the first descenders 7A. The second receiving groove 17B is disposed so as not to overlap the sub-manifold 5*a*. Accordingly, the amount of adhesive that flows into the second inlets 6Bb and the first descenders 7A can be reduced, and portions of the adhesion areas around the second inlets 6Bb are disposed in a region that overlaps the corresponding partition wall 15. Thus, the adhesion strength is increased and liquid leakage can be suppressed.

FIG. 7 illustrates an end of the sub-manifold 5*a* in the long-side direction. The alternate arrangement of the first restricting-portion bodies 6Aa and the second restricting-portion bodies 6Ba ends at the end of the sub-manifold 5*a*. In FIG. 7, a second restricting-portion body 6Ba is at the endmost position. No restricting portion 6 is disposed below the second restricting-portion body 6Ba at the endmost position in FIG. 7, and therefore there is a risk that this second restricting-portion body 6Ba will receive a larger amount of adhesive than other restricting-portion bodies 6*a*. Accordingly, adhesive receiving grooves 17 that extend in the direction in which the second restricting-portion bodies 6Ba extend is disposed on the outer side of the second restricting-portion body 6Ba at the endmost position. In the example illustrated in FIG. 7, the receiving grooves 17 extend parallel to the second restricting-portion bodies 6Ba. If a large amount of adhesive flows from the lower side in FIG. 7 and if only one receiving groove 17 is provided, there is a risk that the receiving groove 17 will be filled with the adhesive and the flow of the adhesive cannot be sufficiently suppressed. Therefore, two or more receiving grooves 17, in other words, a plurality of receiving grooves 17, are preferably provided.

Figure 8A:
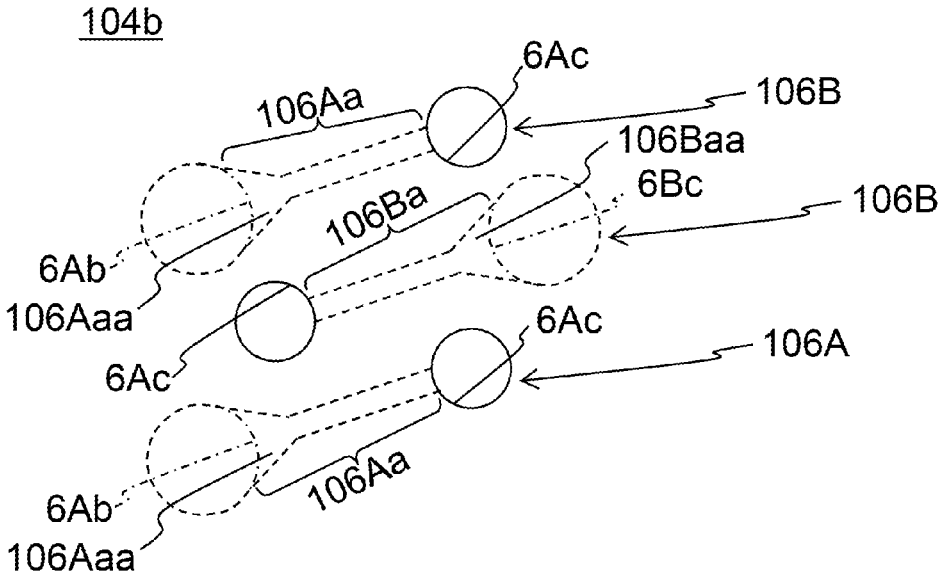
FIGS. 8(*a*) and 8(*b*) are enlarged plan views of the main portion of plates included in head bodies according to other embodiments of the present invention.
Figure 8B:
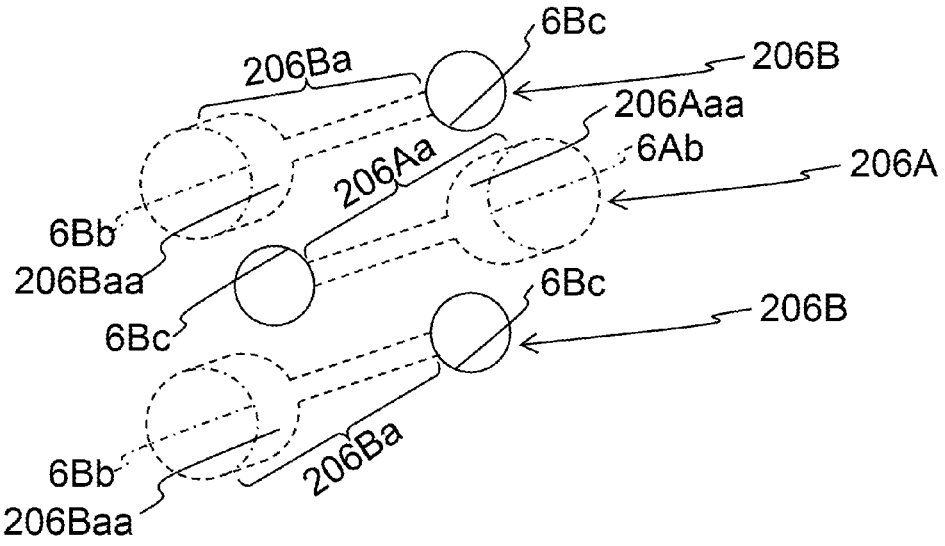

Next, other structures of the restricting portions will be described. FIGS. 8(*a*) and 8(*b*) are plan views illustrating main portions of plates 104*b* and 204*b*, respectively, which may be used in place of the plate 4*b* according to the above-described embodiment. Portions having only small differences from the corresponding portions in the above-described embodiment are denoted by the same reference numerals, and descriptions thereof are thus omitted.

In the plate 104*b*, each first restricting portion 106A includes a first restricting-portion body 106Aa including a first broadening portion 106Aaa having an increasing opening width in a region in front of a first inlet 6Ab at a side adjacent to the first inlet 6Ab. The first broadening portion 106Aaa gradually broadens toward the first inlet 6Ab. In other words, the opening width of the first broadening portion 106Aaa is greater than that of a central portion of the first restricting-portion body 106Aa. With this arrangement, the amount of adhesive that flows into the second outlets 6Bc can be further reduced. Similarly, each second restricting-portion body 106Ba includes a second broadening portion 106Baa. The opening width of the second broadening portion 106Baa is greater than that of a central portion of the second restricting-portion body 106Ba. Accordingly, the amount of adhesive that flows into the first outlets 6Ac can be further reduced.

Also in the plate 204*b*, similar to the above-described example, each first restricting-portion body 206Aa includes a first broadening portion 206Aaa, and each second restricting-portion body 206Ba includes a second broadening portion 206Baa. In other words, the opening width of the first broadening portion 206Aaa is greater than that of a central portion of the first restricting-portion body 206Aa, and the opening width of the second broadening portion 206Baa is greater than that of a central portion of the second restricting-portion body 206Ba. The first broadening portion 206Aaa broadens to substantially the same width as that of the first inlet 206Ab before reaching the first inlet 206Ab, and linearly extends at that width. The second broadening portion 206Baa broadens to substantially the same width as that of the second inlet 206Bb before reaching the second inlet 206Bb, and linearly extends at that width. With this arrangement, even when the first inlets 6Ab in the plate 4*c* are displaced due to, for example, a displacement of the plate 4*c*, variations in the channel resistances of first restricting portions 206A can be reduced. This also applies to second restricting portions 206B.

REFERENCE SIGNS LIST

1 color inkjet printer
2 liquid ejecting head
  2*a* head body
4 channel member
  4*a* to 4*l*, 104*b*, 204*b* plates of channel member
  4-1 ejection-hole surface
  4-2 compression chamber surface
5 manifold
  5*a* opening of manifold
  5*b* sub-manifold
6 restricting portion
  6*a* restricting-portion body
  6*b* inlet
  6*c* outlet
  6A, 106A, 206A first restricting portion
  6Aa, 106Aa, 206Aa first restricting-portion body
  106Aaa, 206Aaa first broadening portion
  6Ab first inlet
  6Ac first outlet
  6B, 106B, 206B second restricting portion
  6Ba, 106Ba, 206Ba second restricting-portion body
  106Baa, 206Baa second broadening portion
  6Bb second inlet
  6Bc second outlet
7 descender
  7A first descender
  7B second descender
8 ejection hole
9 ejection hole row
10 compression chamber
11 compression chamber row
  11A first compression chamber row
  11B second compression chamber row
12 individual channel
15 partition wall
16 dummy compression chamber
17 receiving groove
  17A first receiving groove
  17B second receiving groove
21 piezoelectric actuator substrate
  21*a* piezoelectric ceramic layer
  21*b* piezoelectric ceramic layer
24 common electrode
25 individual electrode
  25*a* individual electrode body
  25*b* lead electrode
26 connecting electrode
28 common-electrode surface electrodes
30 displacement element
60 signal transmission unit
70 head mounting frame
72 head group
80A feed roller
80B take-up roller
82A guide roller
82B conveying roller
88 control unit
P print sheet

The invention claimed is:

1. A liquid ejecting head comprising:

a channel member including a plurality of ejection holes, a plurality of compression chambers connected to the plurality of ejection holes, a common channel that supplies liquid to the plurality of compression chambers; and a plurality of compressing portions that compress the liquid in the plurality of compression chambers, wherein the channel member includes a plurality of plates that include a hole or a groove and that are stacked together to constitute a channel, and wherein, in a plan view of the channel member, the common channel is long in one direction, two compression chamber rows, in which the plurality of compression chambers are arranged next to each other, are arranged one on each side of the common channel so as to extend in the one direction, one of the two compression chamber rows being defined as a first compression chamber row and another of the two compression chamber rows being defined as a second compression chamber row, the compression chambers belonging to the first compression chamber row are connected to the common channel by first restricting portions, the first restricting portions including first restricting-portion bodies that extend in a direction perpendicular to a stacking direction, first inlets that connect the first restricting-portion bodies to the common channel in the stacking direction at a side of the first restricting-portion bodies that is adjacent to the common channel, and first outlets that connect the first restricting-portion bodies to the compression chambers in the stacking direction at a side of the first restricting-portion bodies that is adjacent to the compression chambers, the compression chambers belonging to the second compression chamber row are connected to the common channel by second restricting portions, the second restricting portions including second restricting-portion bodies that extend in a direction perpendicular to the stacking direction, second inlets that connect the second restricting-portion bodies to the common channel in the stacking direction at a side of the second restricting-portion bodies that is adjacent to the common channel, and second outlets that connect the second restricting-portion bodies to the compression chambers in the stacking direction at a side of the second restricting-portion bodies that is adjacent to the compression chambers, the first restricting-portion bodies and the second restricting-portion bodies extend in a direction that crosses the one direction and are alternately arranged in the one direction, and when a direction perpendicular to the one direction is defined as other direction, the first inlets are on one side of the second outlets in the other direction, the second inlets are on other side of the first outlets in the other direction, and the first inlets have an opening width greater than an opening width of the second outlets, and the second inlets have an opening width greater than an opening width of the first outlets.

2. The liquid ejecting head according to claim 1, wherein at least one of the first outlets is disposed between two of the second restricting-portion bodies that are adjacent to each other, and at least one of the second outlets is disposed between two of the first restricting-portion bodies that are adjacent to each other.

3. The liquid ejecting head according to claim 1, wherein the first restricting-portion bodies and the second restricting-portion bodies are constituted by holes in one of the plurality of plates.

4. The liquid ejecting head according to claim 1, wherein the first restricting-portion bodies and the second restricting-portion bodies are constituted by grooves in one principal surface of one of the plurality of plates.

5. The liquid ejecting head according to claim 1, wherein, in the plan view of the channel member, an opening width of portions of the first restricting-portion bodies in front of the first inlets at a side adjacent to the first inlets is greater than an opening width of central portions of the first restricting-portion bodies, and an opening width of portions of the second restricting-portion bodies in front of the second inlets at a side adjacent to the second inlets is greater than an opening width of central portions of the second restricting-portion bodies.

6. The liquid ejecting head according to claim 1, wherein openings of the first inlets and openings of the second inlets in the common channel open in a groove in one principal surface of one of the plates including holes or grooves constituting the common channel, the one of the plates being closest to the first restricting-portion bodies and the second restricting-portion bodies.

7. The liquid ejecting head according to claim 1, wherein the plurality of plates included in the channel member are bonded to each other with an adhesive, and wherein, in the plan view of the channel member, a plurality of second partial channels that connect the plurality of compression chambers belonging to the second compression chamber row to the plurality of ejection holes are arranged in the one direction on the one side of the common channel in the other direction, in at least one principal surface of the plurality of plates including holes or grooves that constitute the first restricting-portion bodies, openings of the plurality of second partial channels are arranged in the one direction, openings of the first inlets are arranged in the one direction, and a first groove for the adhesive is disposed between the openings of the plurality of second partial channels and the openings of the first inlets, the first groove extending in the one direction, and the first groove is disposed so as not to overlap the common channel.

8. The liquid ejecting head according to claim 1, wherein the plurality of plates included in the channel member are bonded to each other with an adhesive, and wherein, in the plan view of the channel member, a plurality of first partial channels that connect the plurality of compression chambers belonging to the first compression chamber row to the plurality of ejection holes are arranged in the one direction on the other side of the common channel in the other direction, in at least one principal surface of the plurality of plates including holes or grooves that constitute the second restricting-portion bodies, openings of the plurality of first partial channels are arranged in the one direction, openings of the second inlets are arranged in the one direction, and a second groove for the adhesive is disposed between the openings of the plurality of first partial channels and the openings of the second inlets, the second groove extending in the one direction, and the second groove is disposed so as not to overlap the common channel.

9. The liquid ejecting head according to claim 1, wherein, in the plan view of the channel member, a portion of at least one of the first restricting-portion bodies, the portion having a length greater than or equal to half of a length of the first restricting-portion bodies, is disposed between two of the second restricting-portion bodies that are adjacent to each other, and a portion of at least one of the second restricting-portion bodies, the portion having a length greater than or equal to half of a length of the second restricting-portion bodies, is disposed between two of the first restricting-portion bodies that are adjacent to each other.

10. The liquid ejecting head according to claim 9, wherein, in the plan view of the channel member, a portion of at least one of the first restricting-portion bodies, the portion having a length greater than or equal to two-thirds of the length of the first restricting-portion bodies, is disposed between two of the second restricting portions that are adjacent to each other, and a portion of at least one of the second restricting-portion bodies, the portion having a length greater than or equal to two-thirds of the length of the second restricting-portion bodies, is disposed between two of the first restricting portions that are adjacent to each other.

11. The liquid ejecting head according to claim 1, wherein the plurality of plates included in the channel member are bonded to each other with an adhesive, and wherein, in the plan view of the channel member, a third groove for the adhesive is disposed on an outer side of one of the first restricting-portion bodies and the second restricting-portion bodies that is disposed at an endmost position in the one direction, the third groove extending in a direction in which the one of the first restricting-portion bodies and the second restricting-portion bodies extends.

12. The liquid ejecting head according to claim 11, wherein the third groove is provided in a plurality.

13. A recording device comprising:

the liquid ejecting head according to claim 1;

a conveying unit that conveys a recording medium relative to the liquid ejecting head; and a control unit that controls the liquid ejecting head.

14. A liquid ejecting head comprising:

a first ejection hole;

a common channel;

a first compression chamber connecting the first ejection hole and a first outlet;

a first restricting portion connecting the common channel and the first compression chamber, that includes a first inlet directly connected to the common channel and the first outlet;

a second ejection hole;

a second compression chamber connecting the second ejection hole and a second outlet; and a second restricting portion connecting the common channel and the second compression chamber, that includes a second inlet directly connected to the common channel and the second outlet;

wherein the first inlet, the first outlet, the second inlet and the second outlet each have an opening width in a plan view; and wherein the opening width of the first inlet is greater than the opening width of the second outlet, and the opening width of the second inlet is greater than the opening width of the first outlet.

15. The liquid ejecting head according to claim 14:

wherein the first outlet and the second outlet are disposed between the first inlet and the second inlet.

16. The liquid ejecting head according to claim 15:

wherein the common channel extends in a first direction, wherein the first outlet and the second outlet are disposed between the first inlet and the second inlet in a second direction perpendicular to the first direction.

17. The liquid ejecting head according to claim 16:

a third ejection hole, a third compression chamber connecting a third inlet and the third ejection hole, and a third restricting portion connecting the common channel and the third compression chamber and comprising a third inlet connecting the common channel, wherein the second outlet is disposed between the first inlet and the third inlet in the second direction.

18. The liquid ejecting head according to claim 17:

wherein the third inlet has an opening width in the plan view and the opening width of the third inlet is greater than the opening width of the second outlet.

19. A recording device comprising:

the liquid ejecting head according to claim 14;

a conveying unit that conveys a recording medium relative to the liquid ejecting head; and a control unit that controls the liquid ejecting head.

* * * * *